United States Patent [19]

Curington

[11] 4,307,780

[45] Dec. 29, 1981

[54] ANGULAR WHIPSTOCK ALIGNMENT MEANS

[75] Inventor: Alfred R. Curington, Woodlands, Tex.

[73] Assignee: Baker International Corporation, Orange, Calif.

[21] Appl. No.: 170,456

[22] Filed: Jul. 21, 1980

[51] Int. Cl.[3] ..... E21B 7/08; E21B 23/00; E21B 47/02

[52] U.S. Cl. ..... 166/113; 33/304; 166/117.6; 166/255; 175/81

[58] Field of Search ..... 166/113, 117.5, 117.6, 166/250, 255; 33/302, 304, 310, 313, 331, 333, 347; 175/79–83

[56] References Cited

U.S. PATENT DOCUMENTS

| | | | |
|---|---|---|---|
| 2,077,381 | 4/1937 | Eastman | 33/304 |
| 2,131,849 | 10/1938 | Tolson | 33/304 X |
| 2,301,307 | 11/1942 | McMahan | 166/113 |
| 2,327,658 | 8/1943 | Miller | 33/310 X |
| 2,405,717 | 8/1946 | Schadel | 33/313 |
| 2,438,293 | 3/1948 | Livingston | 166/117.5 X |
| 2,691,507 | 10/1954 | Brown | 175/82 X |
| 2,782,524 | 2/1957 | Vogt | 33/347 |
| 3,052,309 | 9/1962 | Eastman | 166/117.5 X |
| 3,100,019 | 8/1963 | Tims et al. | 166/117.5 X |

*Primary Examiner*—Stephen J. Novosad
*Attorney, Agent, or Firm*—William C. Norvell, Jr.

[57] ABSTRACT

A compass card is provided for use in achieving the angular alignment of a whipstock relative to a whipstock anchor having a keyway therein for subsequent insertion in a packer apparatus for use in a subterranean well. The compass card comprises an annular card having polar coordinates in mirror image reverse relationship on one face thereof and may have a plurality of sheet-like magnetic elements secured to the other face adjacent a central opening therein.

2 Claims, 14 Drawing Figures

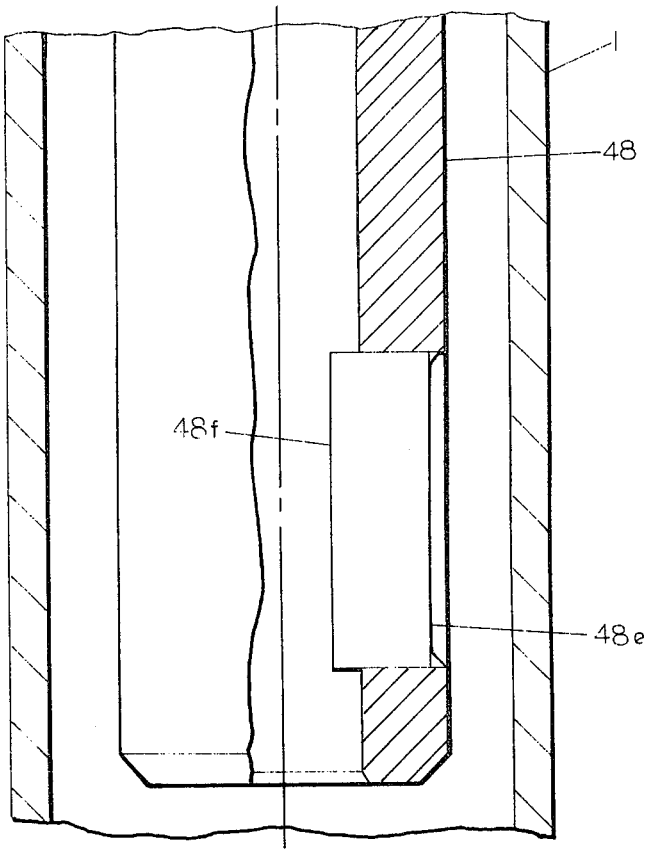
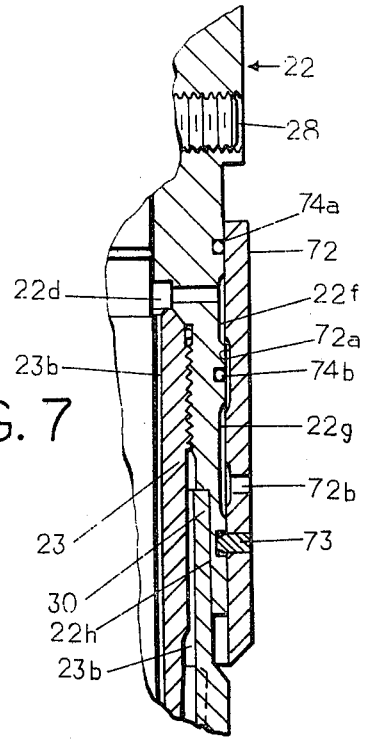
FIG. 7
FIG. 3c
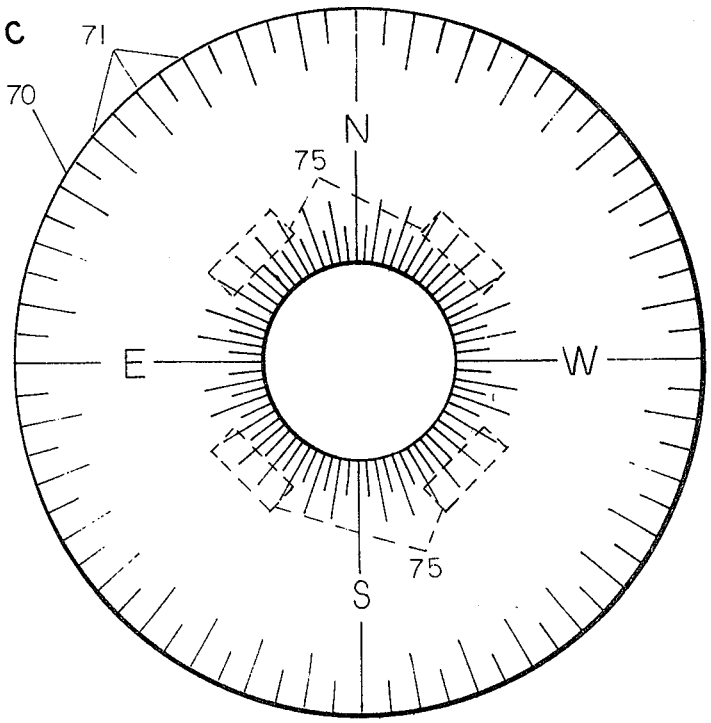
FIG. 5

ANGULAR WHIPSTOCK ALIGNMENT MEANS

BACKGROUND OF THE INVENTION

1. Field of the Invention

The invention relates to a compass card for installing whipstocks in subterranean well conduits to effect the installation of the whipstock with the arcuate face of the whipstock disposed at a desired angular relationship with respect to the conduit.

2. Description of the Prior Art

Obstructions and blockages are often encountered in subterranean well casings which interfere with the production or further drilling of the well. In such cases, it has been the practice to deflect the drilling tool angularly so that it cuts through the casing and then produces a new bore which is directed downwardly and laterally in order to pass around the blockage or obstruction and re-orientate the hole. Whenever it is necessary that such hole or window be cut in the casing wall, it is generally required that the angular position of the window be precisely located, so that the new hole will successfully avoid the blockage or other obstructions and will proceed toward the production formation along a prescribed path.

The angular deflection of the drill bit has in the past been accomplished by the installation of a whipstock which is a guide element having a longitudinally tapered arcuate face so as to deflect the drilling tool angularly toward the inside wall of the casing to permit it to cut a hole or window in the casing. Special packers have heretofore been employed for mounting whipstocks in casings, and a common problem of such prior art packers has been the necessity for installing the packer in a precise angular position within the casing in order to insure that the arcuate face of the whipstock will be precisely positioned at the desired angle. For example, U.S. Pat. No. 4,153,109 issued to Szescila discloses a whipstock mounting system wherein the angular orientation of the arcuate face of the whipstock is determined by the engagement of a key slot provided on the whipstock anchor with a key provided in the central bore of a packer. The packer must, therefore, first be located in the well casing with the key in the precise angular position desired to effect the subsequent precise angular location of the arcuate face of the whipstock. This requirement has resulted in the necessity of employing a tubing string to effect the installation of the packer in the well casing resulting in an expensive and time consuming operation.

SUMMARY OF THE INVENTION

The present invention provides a compass card for use in achieving the angular alignment of a whipstock relative to a whipstock anchor having a keyway therein for subsequent insertion into a packer for utilization in a subterranean well. The compass card comprises an annular card having polar coordinates in mirror image reverse relationship on one face thereof, preferably with a plurality of sheet-like magnetic elements secured to the other face of the card adjacent a central opening therein. The packer designed for utilization with the compass is first lowered into the well conduit and expanded therein at the depth where the cutting of the window is required. The packer is installed by conventional wireline operated equipment, can also be installed on tubing, and is provided with a key projecting into its annular bore which may occupy any given angular orientation relative to the conduit. A conventional well survey is then run to precisely determine the angular location of the packer key, and this location is defined by means of polar coordinates. A whipstock anchor is utilized which has a socket portion in which a whipstock is rigidly secured, and an elongated shaft portion which is rotatable relative to the socket portion about an axis that is coincident with the conduit axis when the shaft portion is installed within the bore of the packer. The shaft portion is provided with a keyway to cooperate with the packer key when installation is effected. The annular compass card is slipped over the shaft portion of the whipstock anchor and a scribe on such shaft portion indicates the angular location of the keyway. The whipstock portion of the anchor is rotated relative to the shaft so as to bring the arcuate tool guiding face of the whipstock into precisely the described angular orientation relative to the keyway that is necessary to effect the cutting of a window through the casing in the described direction when the installation is completed. The whipstock then is rigidly anchored to the shaft by tightening of set screws, and the entire assembly is lowered on drill pipe, or the like, into the conduit and into cooperating relationship with the packer, with the keyway of the shaft of the whipstock anchor engaging the key of the packer. An expandable thread dog mechanism is provided on the whipstock anchor for engagement of the internal threads customarily provided on the packer and to effect the rigid vertical securement of the whipstock and the whipstock anchor into the well conduit, at a predetermined depth, with the arcuate face of the whipstock positioned to face precisely in the direction that the window in the casing is to be cut.

BRIEF DESCRIPTION OF THE DRAWINGS

FIGS. 3*a*, 3*b* and 3*c* together constitute a longitudinal sectional view of a packer for use with the compass, shown with its elements in their well inserting positions and prior to expansion of the elements into engagement with the well casing, FIGS. 3*b* and 3*c* being lower continuations of FIGS. 3*a* and 3*b* respectively.

FIG. 5 is an elevational view of the annular compass card employed to orient the whipstock relative to the whipstock anchor shaft.

FIG. 7 is a partial sectional view similar to FIG. 2*c*, but with the fluid guide sleeve located in its packer inserting position.

DESCRIPTION OF THE PREFERRED EMBODIMENTS

Figure 4:
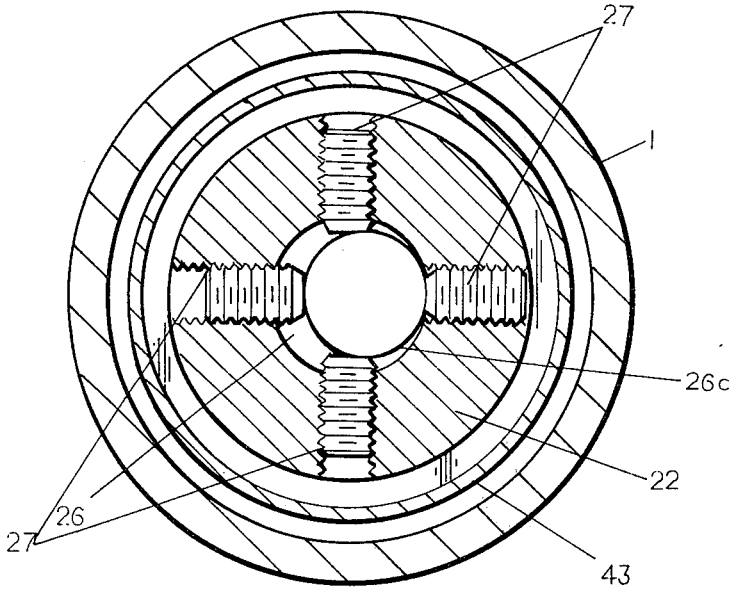
FIG. 4 is a sectional view taken on the plane 4—4 of FIG. 2*c*.

Referring now to FIGS. 1 and 2*a*, 2*b*, 2*c*, 2*d* and 2*e* there is shown a whipstock 10 having an arcuate tool guiding face 13, mounted in a whipstock anchor 20 which includes a socket portion 22, a shaft portion 26, and an anchor sub or sleeve 23 and an expandable thread sleeve 30. The sleeve 30 effects the mounting of the whipstock anchor 20 within the interior bore of a packer assembly 40 which has its upper and lower slips 42 and 44 respectively expanded into gripping engagement with the interior wall 1*a* of the casing 1 and an annular mass of elastomeric material 46 disposed intermediate the upper and lower slips is expanded to sealingly engage the interior wall 1*a* of the casing 1. At the extreme lower end of the packer assembly 40, a key 48*e* is provided which cooperates with an axially extending keyway 26*a* provided in the bottom end of the shaft portion 26 of the whipstock anchor 20. The interengagement of the key 48*e* with the keyway 26*a* determines the angular orientation of the arcuate tool guiding face 13 of the whipstock 10.

The primary purpose of this invention is to provide a compass card useful in conveniently effecting the mounting of the whipstock 10 rigidly within the casing 1 with its arcuate tool guiding face 13 accurately facing exactly the direction in which it is desired to produce a window in the casing 1 by lowering a drilling tool 2 (FIG. 1) into the well which will be guided by the arcuate face 13 of the whipstock into engagement with the side wall of casing 1 to cut the window 1*b*.

Figure 3A:
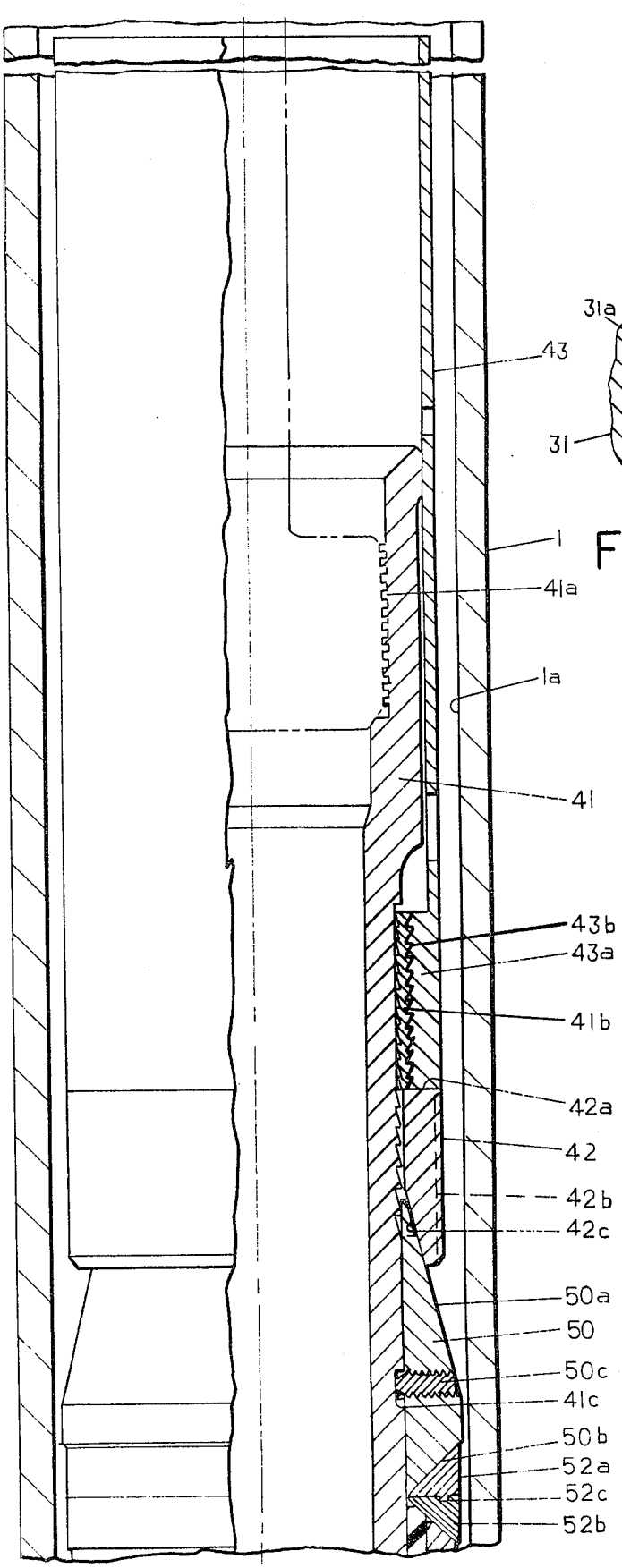
Figure 3B:
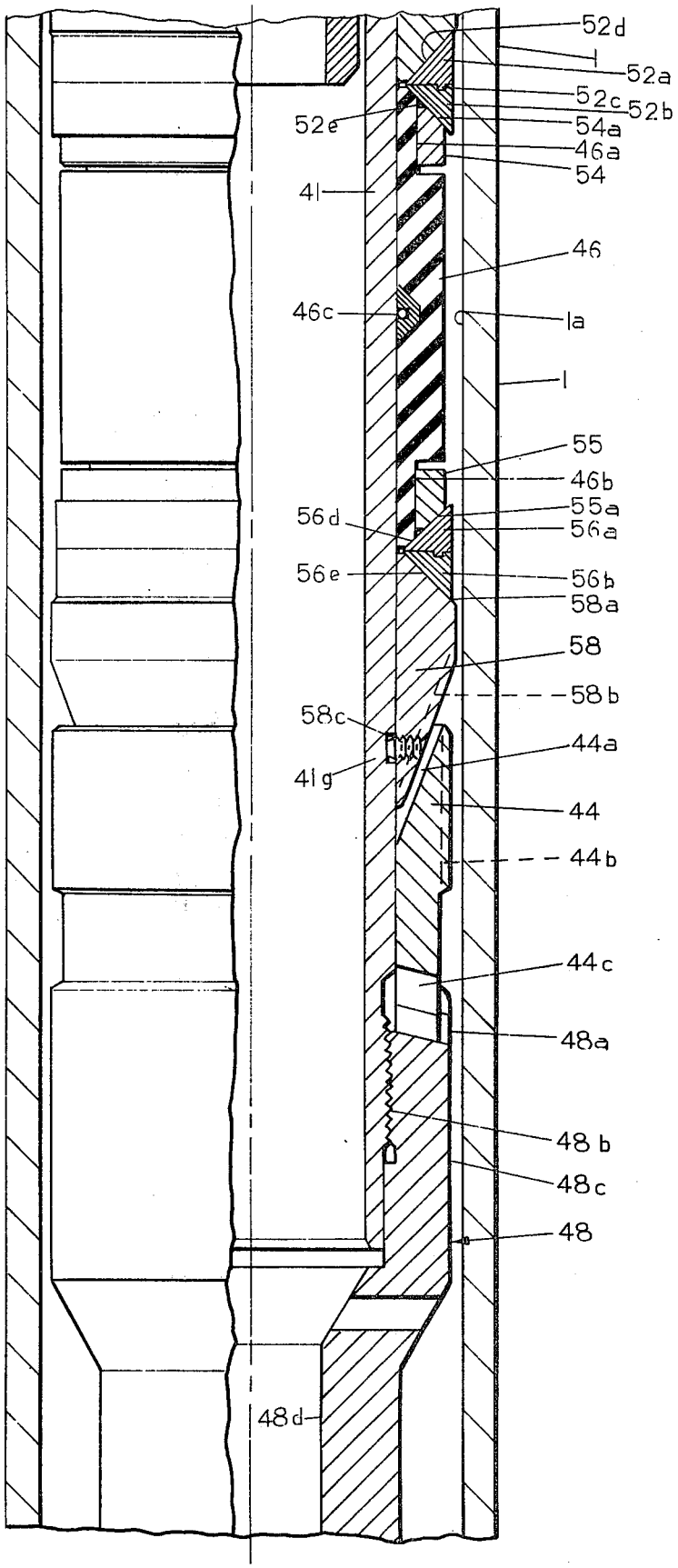

The detailed structure of each of the aforementioned major components, namely, the whipstock, anchor and packer assemblages will now be described. Referring first to FIG. 3*a*, 3*b*, and 3*c*, there is shown only the packer assembly 40 with the various movable elements thereof disposed in the position in which the packer assembly 40 is lowered into the well, i.e., the packer elements occupying the positions prior to expansion of the expandable elements to secure engagement of the packer 40 with the well casing 1.

The packer assembly 40 comprises a central sleeve-like body portion 41 which supports on its outer periphery a plurality of annular elements for effecting the expansion of the upper and lower slips 42 and 44 and the elastomeric packing sleeve 46 into firm engagement with the interior wall 1*a* of the casing 1. The main body sleeve 41 also defines adjacent its upper portions an axially extending length of internal anchor threads 41*a*.

The only other important element in the interior of the packer assembly is the axially extending, inwardly projecting key 48*e* previously mentioned which is rigidly mounted, as by welding, in the lowermost portions of an orientation sleeve 48 which is threadably secured by threads 48*b* to the bottom end of the main packer sleeve 41.

A plurality of relatively movable annular elements are mounted on the outer periphery of the main packer body sleeve 41. At the top of the packer 40, there is first an actuating sleeve 43 which extends upwardly beyond the end of the packer body sleeve 41 by a significant distance. The lower portion of actuating sleeve 43 is provided with an inwardly thickened portion 43*a* which has its internal bore surface formed with ratchet teeth or wickers 43*b* which cooperate with similarly formed external teeth on a body ring 41*b* which is secured to the periphery of the main body sleeve 41 of the packer 40. The purpose of the cooperating ratchet elements 43*b* and 41*b* is to readily permit downward movement of the actuating sleeve 43 relative to the main body sleeve 41 but to prevent any upward relative movement.

Immediately below the bottom end of actuating sleeve 43 is located the radial top surface 42*a* of the upper slip 42. The upper slip 42 is of conventional configuration, having a plurality of serrations or cutting edges 42*b* formed on its outer periphery and a vertically inclined cam surface 42*c* formed on its lower end to cooperate with the similarly inclined top surface 50*a* of an annular camming sleeve or upper cone 50. Additionally, the upper slip 42 is provided with a plurality of axially extending weakening slots (not shown) which permit this element to separate into annular segments when it is displaced outwardly by the cam surface 50*a* of upper cone 50.

A radial shear pin 50*c* is provided in radial relationship in the upper cone 50 engaging a suitable groove 41*c* provided on the external surface of the main body sleeve 41. The shear pin 50*c* maintains the cam 50 in its indicated position shown in FIG. 3*a* during the lowering of the packer 40 into the well casing.

The upper cone 50 additionally is provided with a lower cam surface 50*b* which engages the similarly inclined surface 52*d* of one of a pair of abutting back-up rings 52*a* and 52*b*. Rings 52*a* and 52*b* are axially split so as to permit them to be readily expanded outwardly by the action of the cam surface 50*b* of the upper cone 50 and are interconnected by an annular ridge and slot 52*c* to move as a unit. The axial splits in the elements 52*a* and 52*b* are preferably displaced 180° from each other, permitting both rings to expand into contact with the casing wall 1*a*.

Immediately below the back-up rings 52*a* and 52*b*, the annular mass 46 of elastomeric packing material is mounted. The end portions of the mass 46 are of reduced diameter as indicated at 46*a* and 46*b* and are respectively surrounded by rigid metallic cam rings 54 and 55. Upper ring 54 has an inclined surface 54*a* cooperating with the similarly inclined bottom surface 52*e* of the back-up ring 52*b* while the inclined lower surface 55*a* of cam ring 55 cooperates with the inclined upper surface 56*d* of a pair of back-up rings 56*a* and 56*b* which are identical in construction to the back-up rings 52*a* and 52*b*.

Immediately adjacent the lower inclined surface 56*e* of back-up ring 56*b* is a lower cone 58 having its top surface 58*a* inclined to cooperate in camming relationship to the bottom surface 56*e* of the back-up ring 56*b*. The lower surface of the lower cone 58 is also of inclined configuration and incorporates a plurality of peripherally spaced dove-tailed key slots 58*b* which respectively receive correspondingly shaped elements 44*a* of a lower slip 44. Additionally, the lower cone 58 is provided with a shear pin 58*c* which temporarily engages an annular slot 41*g* provided in the surface of the main body sleeve 41. The outer periphery of the lower slip 44 is provided with a plurality of axially extending teeth or cutting edges 44*b* by which a firm engagement with the inside wall of the casing 1 may be secured when the lower slip 44 is expanded outwardly into engagement therewith.

The bottom end of the lower slip 44 is somewhat downwardly inclined but is similarly provided with dove-tailed slots 44*c* which cooperate with similarly shaped, inclined dove-tailed surfaces 48*a* provided on the top portion of an orientation sleeve 48. The sleeve 48 has a somewhat enlarged upper annular portion 48*c* provided with internal threads 48*b* which are engageable with threads provided on the bottom of the body sleeve 41.

The lower portions of orientation sleeve 48 define a bore 48*d* for slidably receiving the lower end portions of the whipstock anchor shaft 26. The bottom portion of the orientation sleeve 48 is provided with a radial recess within which the key 48*e* is rigidly affixed, such as by welding. The radially inward edge 48*f* of the key 48*e* engages the key slot 26*a* provided in the bottom end portion of the shaft 26 to secure such shaft in a fixed angular orientation relative to the packer assembly 40.

As previously mentioned, FIGS. 3*a*, 3*b* and 3*c* show the packer assembly 40 with its various components in the positions occupied during the running of the packer in the well casing. When the packer has been lowered to the desired vertical position in the well casing, the upper and lower slips 42 and 44 and the elastomeric packing element 46 are expanded into rigid sealing engagement with the interior wall 1*a* of the casing 1. The radial expansion of the elements of the packer assembly to the positions shown in FIGS. 2*c*, and 2*d* may be accomplished by any one of several well known packer expansion actuating devices, for example, the apparatus shown in U.S. Pat. No. 3,208,355 to Baker et al, which effects the necessary relative movements of elements of the packer assembly through forces derived by gas pressure developed by the explosion of a contained slow-burning powder charge or pellet. In any event, the setting of the packer is accomplished by concurrently applying a downward force to the top end 43*c* of the actuating sleeve 43, and an upward force to the internal square threaded portion 41*a* provided on the packer body portion 41.

The application of such relative forces results in a relative downward movement of the actuating sleeve 43, thus forcing the upper slip 42 outwardly to first split into annular segments and then to grip the casing wall 1*a* by virtue of its engagement with the conical cam surface 50*a* of the upper cone 50. The downward component of force on the upper cone 50 produced by such movement effects the severance of the shear pin 50*c* and the upper cone 50 then produces a downward and outward movement of the back-up rings 52*a* and 52*b*. These rings move outwardly toward the inner wall 1*a* of the casing 1 and at the same time exert a downward force on the cam ring 54 and, hence, on the annular elastomeric packing 46, forcing it outwardly by virtue of the compressive forces exerted thereon. The back up rings 52*a* and 52*b* effectively prevent axial displacement of the elastomeric packing 46.

Due to the fact that the packer body sleeve 41 is concurrently moving upwardly, similar actions are occurring at the lower end of the packer assembly to effect the outward expansion of the lower slip 44. The shearing of the shear pin 58*c* in the lower cone 58, and the upward and outward urging of the lower back-up rings 56*a* and 56*b* exert a compressive force on the elastomeric sleeve 46 thru the cam ring 55. As previously mentioned, the inter-engaging ratchet teeth 43*b* of the sleeve portion 43*a* and the lock sleeve 41*b* prevent any reverse relative movement of the actuating sleeve 43 and the packer body sleeve 41. Hence, once the respective expansion of the upper and lower slips 42 and 44 and the packing sleeve 46 into rigid engagement with the inner wall 1*a* of casing 1 has been accomplished, the packer is locked in such position relative to the casing and fluid flow between the exterior of the packer and the casing is effectively eliminated by the elastomeric packing 46. Any fluid leakage between the exterior of the packer body sleeve 41 and the expandable elements is eliminated by a seal structure 46*c* provided in the center of the elastomeric sleeve 46.

The packer 40 is, of course, anchored at a depth in the well which is slightly below the location of the window 1*b* that is desired to be cut in the casing 1 by a cutting tool 2 guided by a whipstock. The next step is to lower a well directional surveying apparatus into the well to determine the exact angular position of the key 48*e* of the anchored packer. A conventional and known gyroscopic survey apparatus is employed for this service which may actually engage the key 48*e* and provide an indication of its angular position relative to polar coordinates.

The completion of the survey thus provides the operator with precise knowledge of the angular position of the key 48*e* with respect to the normal polar coordinates. The operator then proceeds to assemble the whipstock, and the whipstock anchor and to effect the angular adjustment of the whipstock relative to the keyway provided in the bottom end of the whipstock anchor shaft. Such assembly operations are performed, of course, at the earth surface and do not require welding or other special machining operations.

Referring now to FIGS. 2*a*, 2*b*, 2*c*, and 2*d*, the assembled whipstock 10, whipstock socket 22, whipstock shaft 26 and the anchor sub 23 are illustrated. The whipstock 10 includes a lower anchor section 12 and an upper section 11 which has a partially cylindrical or convex exterior and a concave tapered inner tool guiding face 13. The lower end of the upper section is connected to the lower anchor section by means of a hinge pin 14. The anchor section 12 is threadably secured to the internal threads 22*a* provided in the socket portion 22 of the whipstock anchor. A plurality of radially disposed set screws 22*b* effect the securement of the threaded connection.

Immediately below the socket portion 22, the whipstock socket 22 is provided with internal threads 22*k* that engage the top end of the generally cylindrical guide sleeve 23 which extends a substantial distance into the packer and at its lower end is provided with an axially extending annular recess 23*a* within which a plurality of chevron-type seals 24 are provided to sealingly engage the internal bore surface 41*d* of the packer body sleeve 41. The bore 23*b* of the anchor sleeve 23 receives the anchor shaft portion 26 therein.

The bottom end of the anchor sleeve 23 is threaded at 23*c* to receive a shaft retaining sleeve or nut 25 which has an internally projecting shoulder 25*a* engaging an external shoulder 26*b* on the shaft 26 to hold the shaft in assembly prior to locking it to the socket portion 22 of the anchor assembly 20.

The extreme top portion 26*c* of the anchor shaft 26 is provided with an eccentric configuration, illustrated in FIG. 4, and a plurality of radially disposed set screws 27 are mounted in the socket portion 22 to engage the eccentric shaft portion 26*c* and secure it against angular displacement with respect to the whipstock socket, once the socket 22 has been correctly oriented relative to the keyway 26*a* provided in the bottom end of the anchor shaft.

Figure 8:
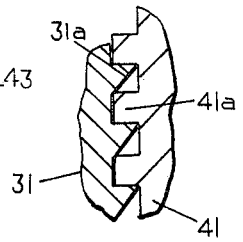
FIG. 8 is an enlarged scale, partial sectional view of the anchor teeth portion of the packer.

The guide sleeve 23 is secured in surrounding relationship to the shaft 26 by internal threads 22*k* provided at the top end portion of sleeve 23 and the lower end of whipstock anchor socket 22. In an internal annular recess 22*h* provided in the bottom portion of socket 22 an expandable anchor sleeve 30 is mounted. The lower portions of anchor sleeve 30 are axially slotted to provide a plurality of annular segmental locking dogs 31, each of which has teeth portions 31*a* formed on their peripheries which cooperate with the internal square threads 41*a* provided on the packer body sleeve 41 (FIG. 8). The threaded dog elements 31 are not shown in detail since they are commonly employed in the art to effect the anchoring of a whipstock or any other form of downhole apparatus to the internal threads of a packer by being axially insertable within such threads and then radially expanded to engage the internal threads in threaded relationship. See, for example, U.S. Pat. No. 2,737,248 to Baker.

The external periphery of the guide sleeve 23 is suitably recessed as indicated at 23*b* to provide adequate clearance for inward deflection of the locking dogs 31 as the whipstock anchor assembly is inserted within the packer assembly 40. Additionally, the axial splines 23*m* are formed on the sleeve 23 lying intermediate dogs 31 to key the sleeves 30 and 23 together. Upon full insertion of the whipstock anchor assemblage 20 in the packer 40, the downwardly facing shoulder 23*e* provided on the sleeve 23 engages an upwardly facing shoulder 41*e* provided in the internal bore of the packer body sleeve 41. To permit insertion of the anchor sleeve 30, the threaded dog segments 31 slip past the internal threads 41*a* of the packer by virtue of being inclined surfaces on the bottom edges of the threads 31*a*. However, once the whipstock anchor assembly 20 reaches its described lowermost position, a slight upward movement of the assembly produced by the drill pipe 16 results in an outward camming of the locking dogs 31 through the engagement of the upwardly facing inclined surface 23*f* provided on the anchor sleeve 23 with the downwardly facing inclined surface 31*b* provided on the bottom ends of the cam dogs 31. As a result, the cam dogs 31 are fully threadably engaged with the interior threads 41*a* of the packer body sleeve 41 and the whipstock anchor 20 is rigidly secured to the packer assembly 40.

Figure 6:
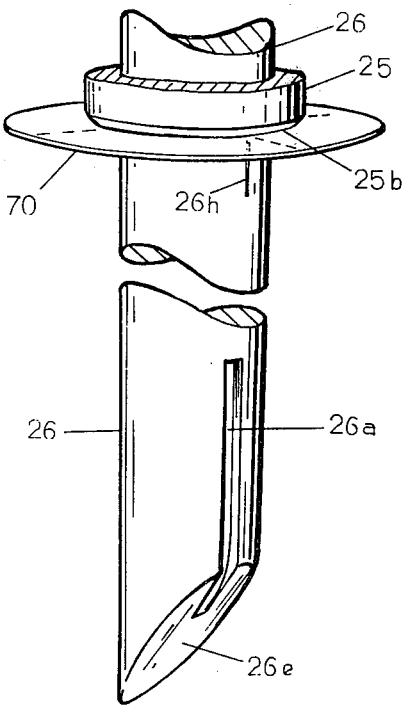
FIG. 6 is a perspective view showing the utilization of the compass card of FIG. 5 in the orientation procedure.
Figure 1:
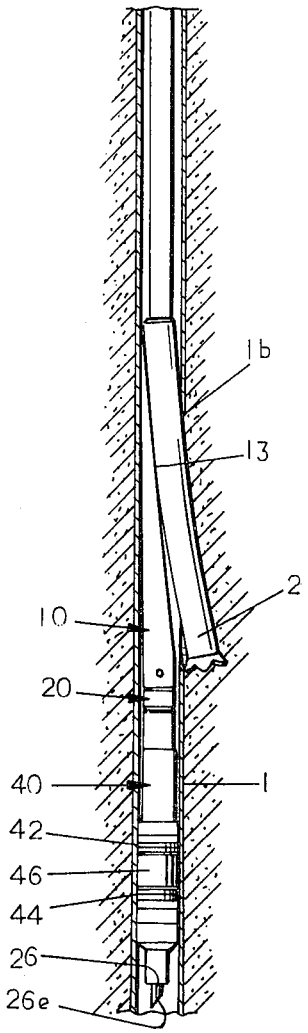
FIG. 1 is a side elevational view of an assembled whipstock and packer constructed for use with the compass card.
Figure 2A:
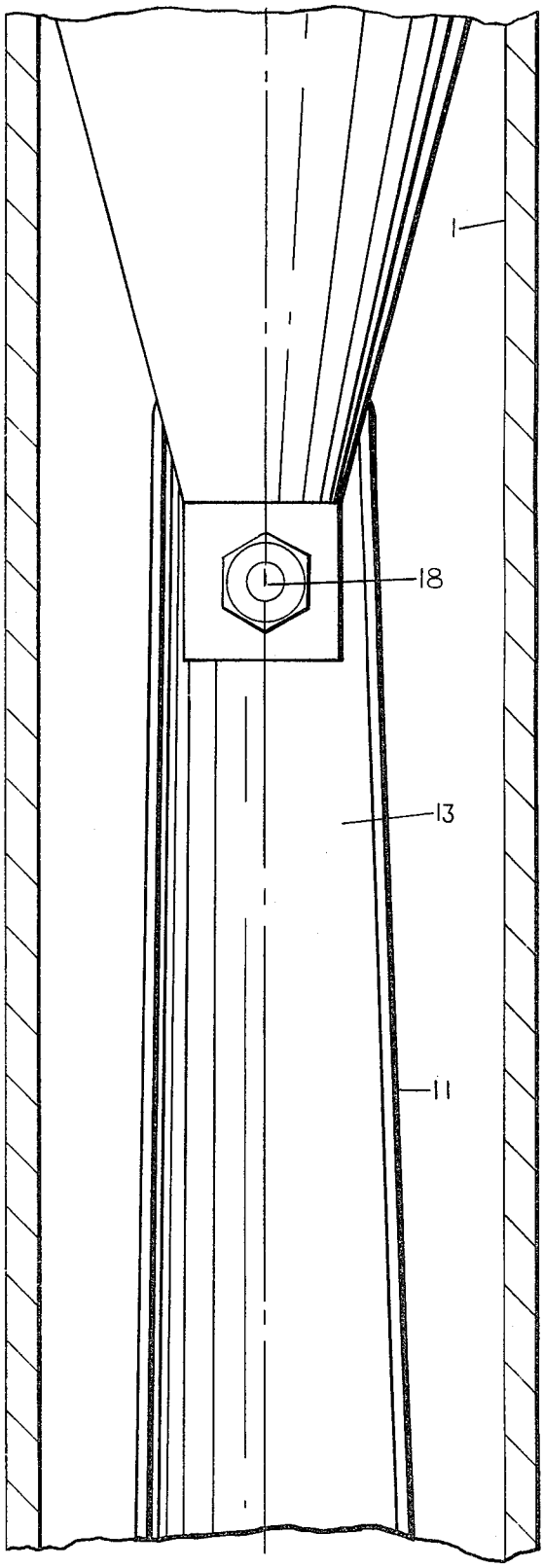
FIGS. 2*a*, 2*b*, 2*c*, 2*d* and 2*e* together constitute an enlarged scale combined side elevational view and longitudinal section of the whipstock and packer shown in FIG. 1, FIGS. 2*b*, 2*c*, 2*d* and 2*e* being lower continuations of FIGS. 2*a*, 2*b*, 2*c* and 2*d*, respectively.
Figure 2B:
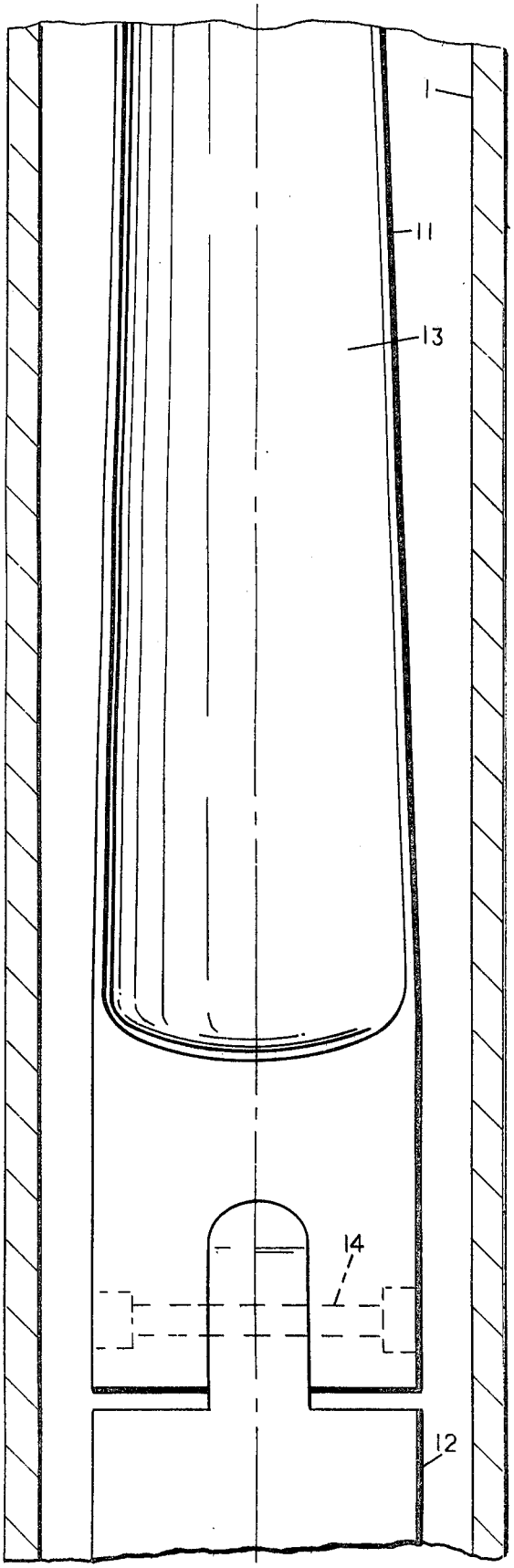
Figure 2C:
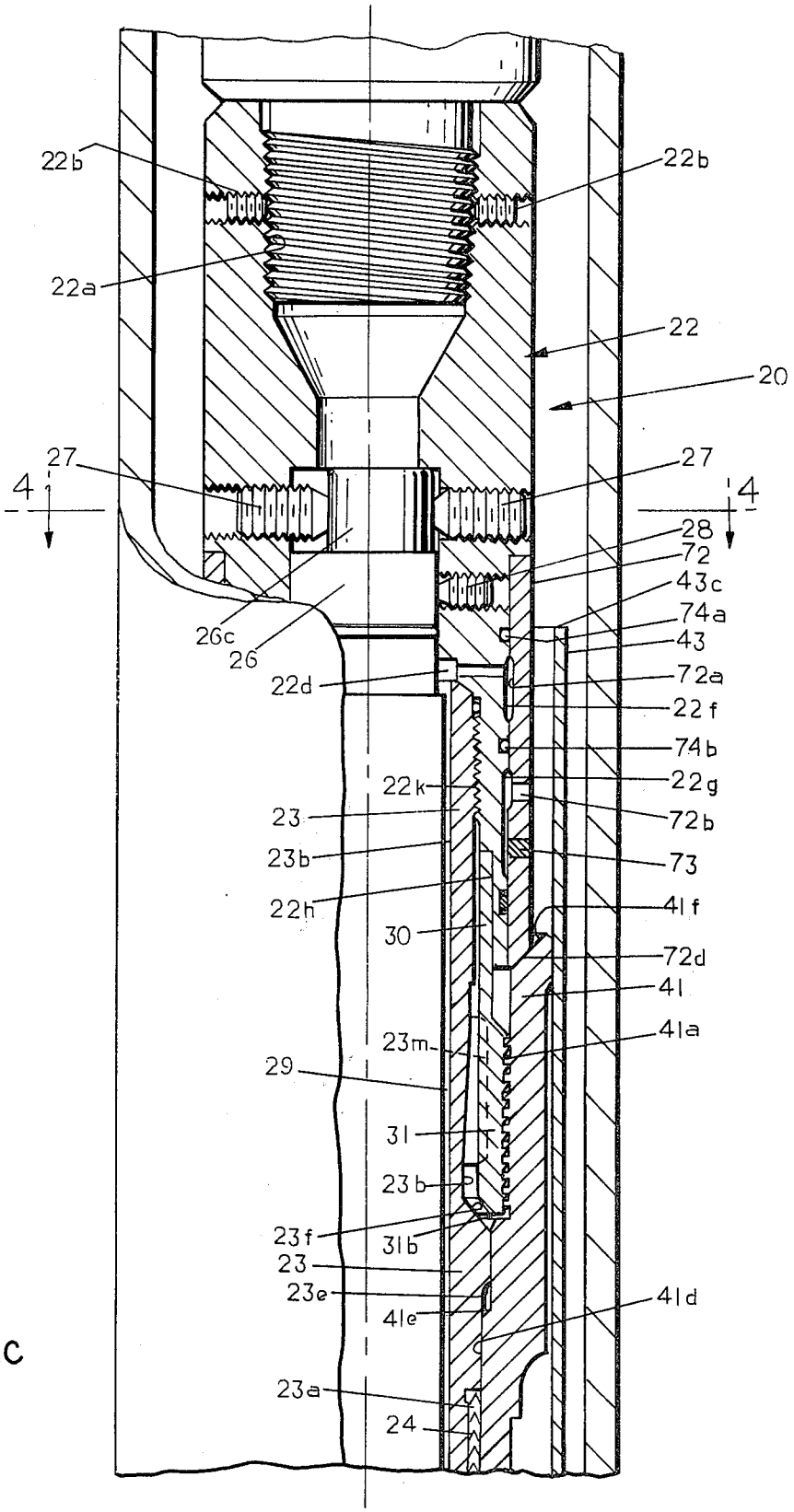
Figure 2D:
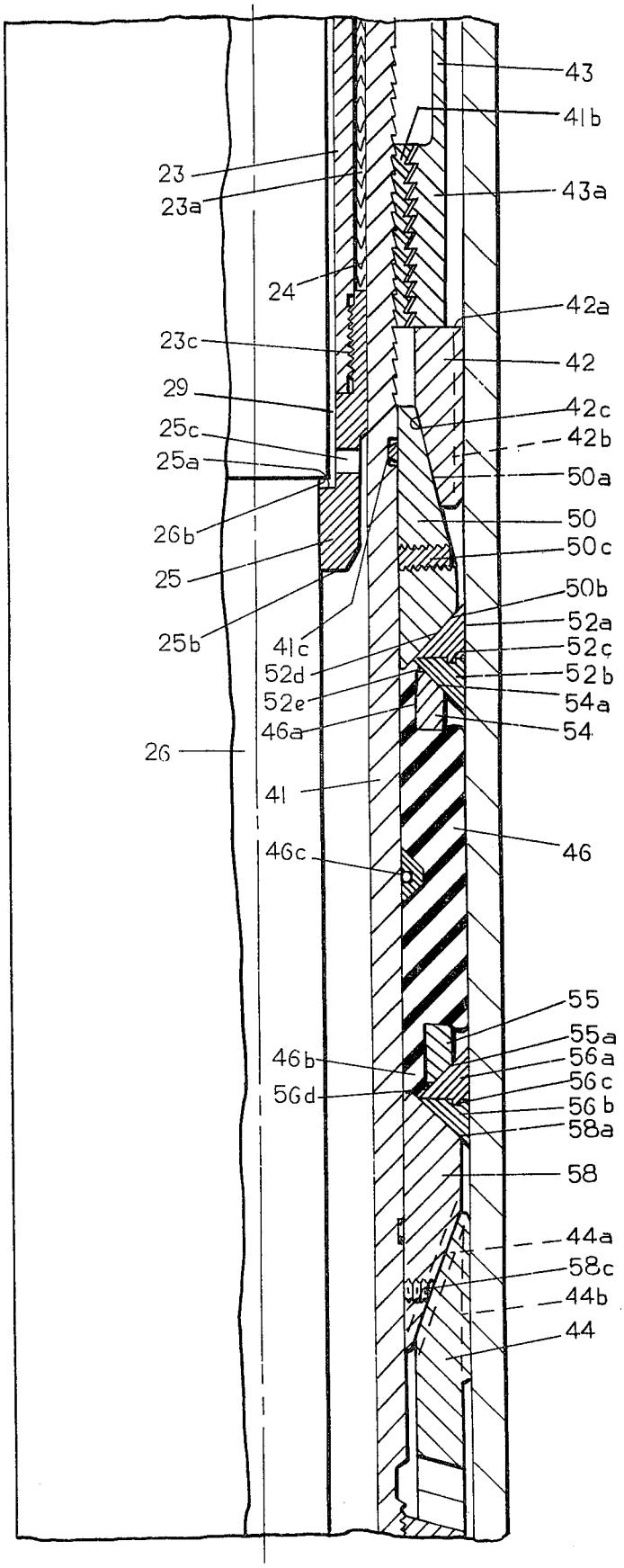
Figure 2E:
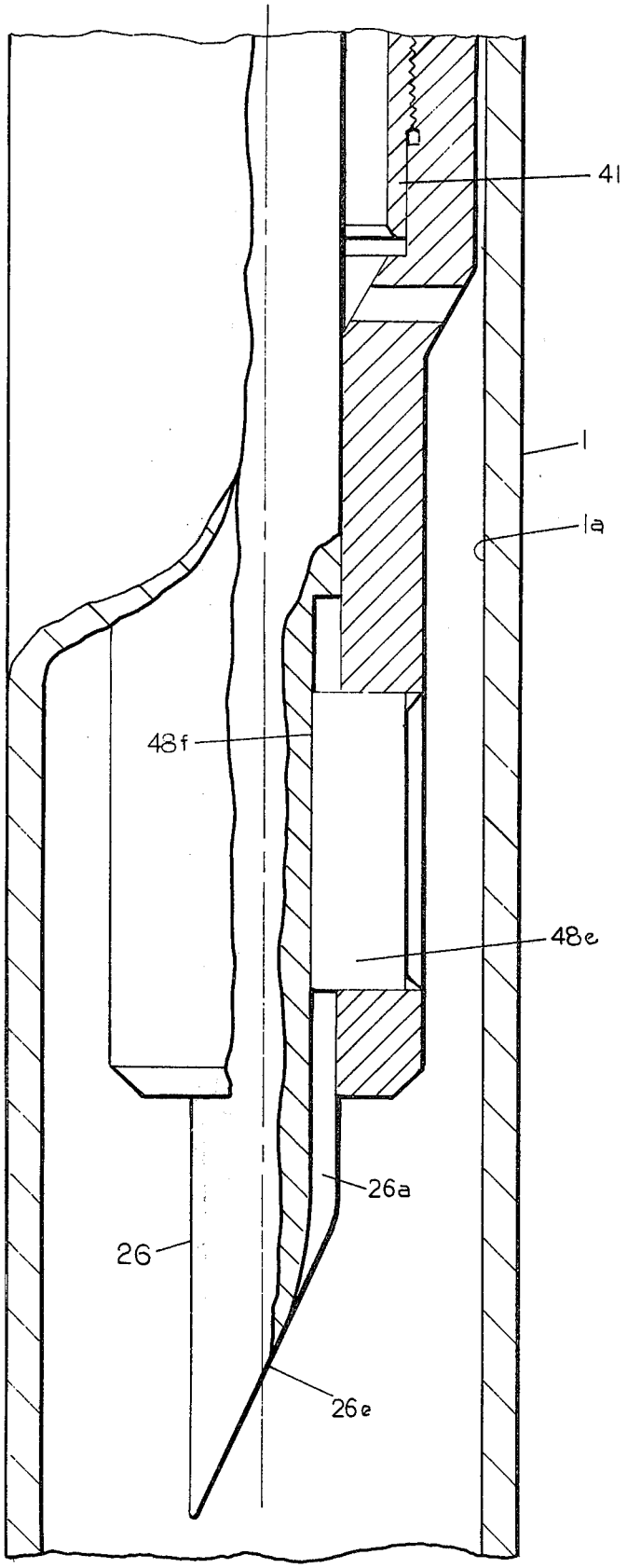

Prior to insertion of the whipstock anchor assembly into the packer assembly, it is necessary to angularly orient the arcuate tool guiding face 13 of the whipstock 10 relative to the keyway 26*a* provided in the bottom of the anchor shaft 26. Referring now to FIGS. 5 and 6, this invention provides a convenient apparatus for accurately effecting such angular orientation. An annular compass card 70 is provided having polar coordinates 71 printed on one face thereof. Such coordinates are, however, in mirror image reversed relationship to the normal direction of polar coordinates, because the annular compass card 70 will be applied to the shaft portion 26 of the whipstock anchor assembly 20 in an upside down relationship.

The annular compass card 70 may be slipped over one end of the shaft 26 and moved until the compass card engages the radial end face 25*b* of the retaining nut or sleeve 25. In this position, the compass card 70 intersects the vertical scribe line 26*h* which is angularly aligned with the center of the keyway 26*a*. The top surface of the compass card 70 is provided with a plurality of radially spaced, sheet like magnetic elements 75 which engage the radial end face 25*b* and adjustably secure the compass card 70 in position thereon, yet permitting convenient angular adjustment of such compass card relative to the axis of the shaft 26. The polar coordinates 71 on the compass card 70 are on the bottom face of the card and hence readily readable.

The directional well survey that had been previously made has provided an indication of the actual angular orientation of the key 48*e* in terms of polar coordinates. The desired direction of facing of the tool guiding surface 13 of the whipstock 10, when installed, is also known in terms of polar coordinates. Therefore, the correct angular displacement of the whipstock arcuate face 13 relative to the keyway 26*a* will be known. It is therefore only necessary to angularly adjust the position of the whipstock anchor socket portion 22 about the axis of the anchor shaft 26 in order to effect the desired orientation of the face 13 of the whipstock 10.

Such location of the working face 13 of the whipstock 10 may be conveniently achieved by securing a flexible line or string to the shear pin 18 by which the whipstock upper section 11 is connected to the drill pipe 16. The string is then pulled downwardly along the whipstock anchor assembly and positioned in a plane that passes through the axis of the whipstock shaft 26 and also corresponds to the facing direction of the tool guiding surface 13 of the whipstock 10. This line or string (not shown) is pulled across the edge of the annular compass card 70 and the compass card will then indicate the degrees of angularly displacement of the tool guiding face 13 of the whipstock relative to the scribed line 26*h* hence relative to keyway 26*a* in the bottom of shaft 26. The whipstock anchor portion 22 is angularly shifted about the eccentric top portion 26*c* of the anchor shaft 26 until the string and compass card indicate that the desired degree of angular displacements of the tool guiding face 13 of the whipstock 10 relative to the keyway 26*a* of the shaft 26 has been achieved. At this point, a set screw 28, passing radially through the anchor socket portion 22 is tightened against the adjacent portion of the shaft 26 and then the plurality of radially disposed set screws 27 are tightened against the eccentric top portion 26*c* of shaft 26 to effect the rigid securement of such shaft to the whipstock anchor portion 22 with the desired angular relationship being maintained between the tool guiding face 13 of the whipstock 10 and the keyway 26*a* of the whipstock shaft 20.

The compass card 70 can then be removed from the shaft 26, and the whipstock 10 and its anchor assembly 20 is ready for insertion in the well by the drill pipe 16.

To facilitate the alignment of the whipstock shaft keyway 26*a* with the anchor key 48*e*, a tapered mule shoe configuration 26*e* may be provided for the bottom end of the shaft 26. This configuration cooperates with the top edge of the key 48*e* to turn the shaft 26 and the remaining elements of the whipstock anchor assembly 20 with it until the keyslot 26*a* in the shaft 26 is aligned with the internally projecting key 48*e* whereupon the key 48*e* enters the key slot 26*a* and the whipstock anchor assembly 20 moves into its lowermost position relative to the packer 40.

In most instances, there will be fluid contained within the bore of the packer body sleeve 41 when the whipstock anchor assembly 20 is being lowered therein. Since the chevron type seals 24 carried by the anchor sleeve 23 effectively prevent any upward flow of such fluid, it is necessary to provide a temporary bypass for such fluid to permit the convenient insertion of the whipstock anchor assembly 20 into the packer assembly 40. Such fluid bypass comprises a radial port 25*c* provided in the retaining sleeve or nut 25, which communicates with an upwardly extending annular space 29 provided between the exterior of the shaft 26 and the interior of the anchor sleeve 23. The annular space 29 in turn communicates with a radial port 22*d* provided in the whipstock anchor socket portion 22.

Fluid passing out of the radial port 22*d* is directed to the interior of the casing 1 prior to the final setting of the whipstock anchor assembly 20 in the packer assembly 40 by fluid passages provided in an axially shiftable fluid guide sleeve 72 which is mounted in surrounding relationship to the socket portion 22 and the anchor sleeve 23. The sleeve 72 is provided with an annular passage 72*a* which, during the well inserting of the anchor assembly 20, is in fluid communication at its top and bottom ends with annular recesses 22*f* and 22*g*, respectively, provided in the periphery of the socket portion 22. The recess 22*g*, in turn, communicates with a radial port 72*b* provided in the fluid guide sleeve 72 which communicates with the interior of the casing.

A shear pin 73 holds the fluid guide sleeve 72 in the position shown in FIG. 7 until just prior to the final seating of the whipstock anchor assembly 20 in the packer 40. As the final vertical seating position of the whipstock anchor assembly 20 in the packer 40 is approached, an upwardly facing shoulder 41*f* (FIG. 2*c*) on the packer body sleeve 41 engages the the bottom surface 72*d* of the fluid guide sleeve 72 and moves it upwardly, shearing the shear pin 73, and aligning the annular passage 72*a* exactly with the annular passage 22*f* provided in the whipstock socket portion 22. Concurrently, O-ring seals 74*a* and 74*b* respectively provided in the periphery of the whipstock anchor socket portion 22 are disposed on opposite sides of the aligned annular passages 22*f* and 72*a* and the seals effectively block any further fluid flow through the bypass.

From the foregoing description, it will be readily apparent to those skilled in the art that the apparatus of this invention provides a most economic and highly reliable system for effecting the installation of a whipstock anchor in a packer so that the tool guiding face of the whipstock can be disposed in the desired angular configuration. Furthermore, the installation of the whipstock anchor assembly of this invention completely blocks all portions of the well below the whipstock anchor assembly and prevents the entry therein of undesired particulate material produced in the subsequent drilling or production operations conducted through the window cut in the wall of the casing.

It should also be recognized that it is entirely a matter of choice as to whether the key is provided on the packer or on the whipstock anchor shaft. For this reason, the language employed in the claims will interchangeably refer to either the key or the keyslot as a "key element."

Although the invention has been described in terms of a specific embodiment which is set forth in detail, it should be understood that this is by illustration only and that the invention is not necessarily limited thereto, since alternative embodiments and operating techniques will become apparent to those skilled in the art in view of the disclosure. Accordingly, modifications are contemplated which can be made without departing from the spirit of the described invention.

What is claimed and desired to be secured by Letters Patent is:

1. A compass card for use in achieving the angular alignment of a whipstock relative to a whipstock anchor shaft having a keyway therein for subsequent insertion in a packer for a subterranean well, comprising an annular card having a circular opening constructed and arranged to slidably fit on the whipstock anchor shaft and be angularly adjustable about the shaft axis, said card having polar coordinates in image reversed relationship on one face thereof.

2. A compass card as defined in claim 1 further comprising a plurality of sheet-like magnetic elements secured to the other face of the card adjacent the central opening therein.

* * * * *